US008292265B2

(12) United States Patent
Benzing

(10) Patent No.: US 8,292,265 B2
(45) Date of Patent: Oct. 23, 2012

(54) MOBILE SUPPORT APPARATUS

(76) Inventor: James T. Benzing, Bethlehem, PA (US)

( * ) Notice: Subject to any disclaimer, the term of this patent is extended or adjusted under 35 U.S.C. 154(b) by 294 days.

(21) Appl. No.: 12/833,087

(22) Filed: Jul. 9, 2010

(65) Prior Publication Data

US 2011/0014026 A1 Jan. 20, 2011

Related U.S. Application Data

(60) Provisional application No. 61/226,490, filed on Jul. 17, 2009.

(51) Int. Cl.
*B62B 3/00* (2006.01)

(52) U.S. Cl. ..... 254/2 R; 254/2 B; 254/10 C

(58) Field of Classification Search ..... 254/2 R, 254/2 C, 7 C, 10 B, 10 C, 8 B, 93 R, 93 L, 254/89 H, 134, 133 R
See application file for complete search history.

(56) References Cited

U.S. PATENT DOCUMENTS

| | | | | |
|---|---|---|---|---|
| 3,085,785 | A | 4/1963 | Peterson | |
| 3,920,096 | A * | 11/1975 | Fisher | 182/69.5 |
| 4,502,569 | A | 3/1985 | Loechner | |
| 4,752,102 | A * | 6/1988 | Rasmussen | 297/344.2 |
| 4,763,800 | A * | 8/1988 | Engler et al. | 212/195 |
| 6,330,951 | B1 | 12/2001 | Johnston | |
| 6,883,641 | B2 * | 4/2005 | Julien | 182/69.1 |
| 7,311,295 | B2 * | 12/2007 | Ha | 254/122 |
| 7,478,450 | B2 | 1/2009 | Fong | |
| 7,493,987 | B2 * | 2/2009 | Puszkiewicz et al. | 182/69.5 |
| 7,950,628 | B2 * | 5/2011 | Warren et al. | 254/122 |
| 2005/0211868 | A1 | 9/2005 | Scott | |
| 2007/0163058 | A1 | 7/2007 | Homsi | |
| 2009/0026325 | A1 | 1/2009 | Roberts | |
| 2011/0014026 | A1 * | 1/2011 | Benzing | 414/800 |

* cited by examiner

*Primary Examiner* — Lee D Wilson
(74) *Attorney, Agent, or Firm* — Design IP

(57) ABSTRACT

A mobile support apparatus that includes one or more extension and retraction devices and a unit that is releasably attachable to vertical members of the apparatus such that the apparatus can be extended in one or more stages to a vertical height that is substantially greater than the height of the fully retracted apparatus. The mobile support apparatus is useful for a multitude of new and existing construction-related applications.

20 Claims, 9 Drawing Sheets

MOBILE SUPPORT APPARATUS

CROSS-REFERENCE TO RELATED APPLICATION

This application claims the benefit of U.S. Provisional Application No. 61/226,490, filed Jul. 17, 2009, which is incorporated herein by reference in its entirety.

BACKGROUND OF THE INVENTION

The invention relates to temporary support apparatuses, particular apparatuses used to support high-weight structures during a construction process.

Typically, large-scale construction requires the use of expensive and bulky equipment to provide temporary support for structures as they are being constructed or renovated. Overhead cranes and gantry cranes require extensive setup time and are highly limited in that they cannot be used where there is insufficient overhead clearance for positioning of the lifting apparatus. Overhead cranes and gantry cranes have the additional disadvantages of requiring substantial ground clearance or other support bases on the sides of the structure that is to be supported. These cranes are also prohibitively expensive to purchase or rent, and due to their large size, are very difficult to transport and operate.

Vehicle-mounted cranes are limited in that they require substantial clearance for positioning of the vehicle chassis adjacent to the work zone, and additional clearance for proper extension of the outriggers. Vehicle-mounted cranes are also highly limited in their lifting capacity, and are very expensive to purchase, rent, and maintain. Further, these cranes require substantially level ground for setup of the vehicle chassis, and require extensive setup time before they can be used. They also suffer from the same drawback as do overhead cranes and gantry cranes with respect to the requirement of sufficient overhead clearance.

Existing multi-stage and telescoping support apparatuses do not have high weight capacity, and are not mobile. In addition to also having a high purchase cost, these apparatuses are bulky and difficult to transport.

Accordingly, there is a need for a low cost, mobile support apparatus that can be quickly set up in the desired location and raised into position to temporarily support a high-weight structure.

BRIEF DESCRIPTION OF THE INVENTION

To be completed upon approval of the claims.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings certain embodiments of the present invention. It should be understood, however, that the invention is not limited to the precise arrangements and instrumentalities shown. In the drawings, the same reference numerals are employed for designating the same elements throughout the several figures. In the drawings.

DETAILED DESCRIPTION OF THE PREFERRED EMBODIMENTS

Figure 1:
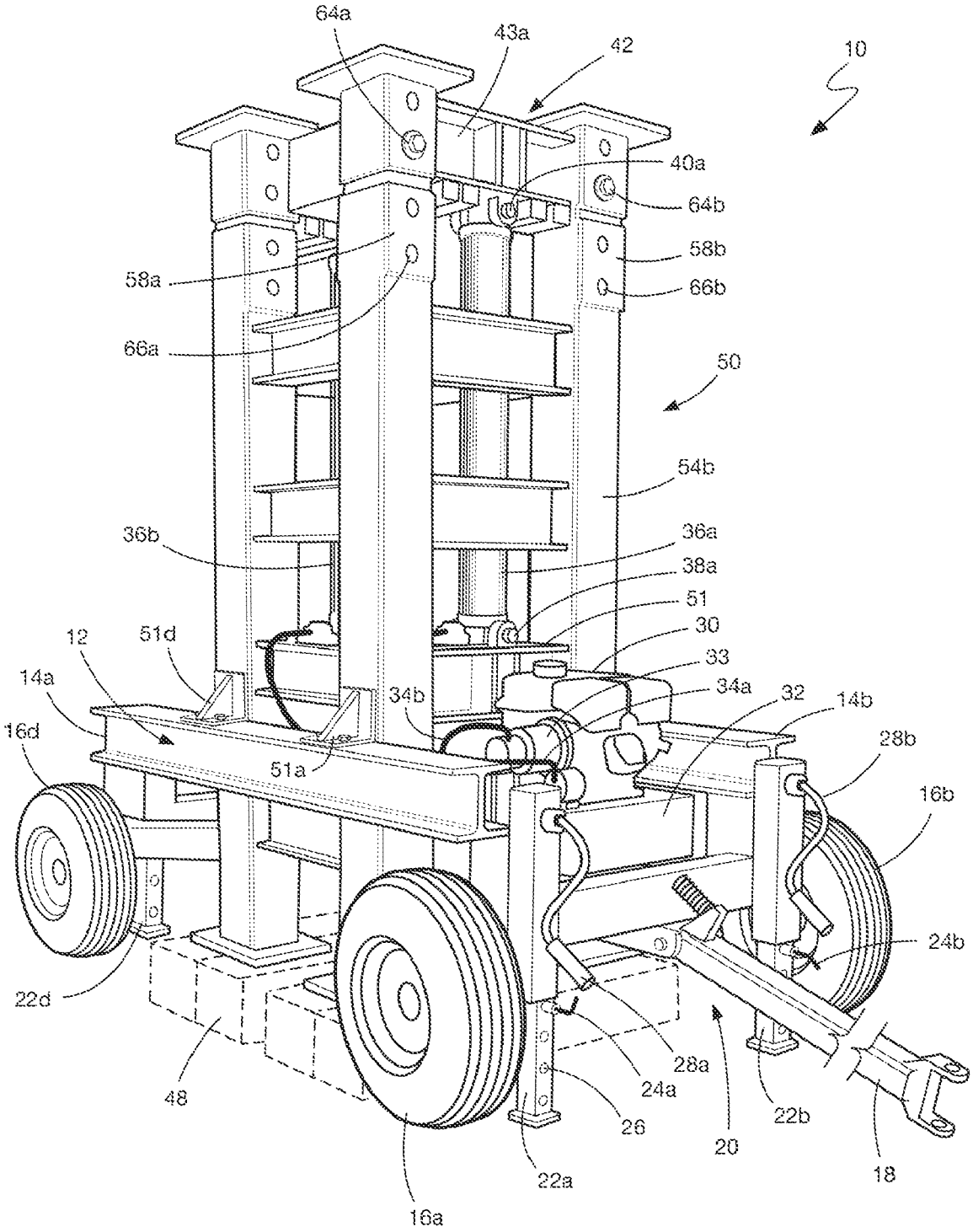
FIG. 1 is a front perspective view of one embodiment of the mobile support apparatus with the wheels in engagement with the ground.

The ensuing detailed description provides preferred exemplary embodiments only, and is not intended to limit the scope, applicability, or configuration of the invention. Rather, the ensuing detailed description of the preferred exemplary embodiments will provide those skilled in the art with an enabling description for implementing the preferred exemplary embodiments of the invention. It being understood that various changes may be made in the function and arrangement of elements without departing from the spirit and scope of the invention, as set forth in the appended claims.

To aid in describing the invention, directional terms are used in the specification and claims to describe portions of the present invention (e.g., upper, lower, left, right, etc.). These directional definitions are merely intended to assist in describing and claiming the invention and are not intended to limit the invention in any way. In addition, reference numerals that are introduced in the specification in association with a drawing figure may be repeated in one or more subsequent figures without additional description in the specification in order to provide context for other features.

Referring generally to FIGS. 1-7, an exemplary embodiment of a mobile support tower 10 according to the present invention is shown. As can best be seen in FIGS. 1 and 2, the tower 10 comprises a transport chassis 12. In this embodiment, the transport chassis 12 is comprised of a pair of horizontal chassis beams 14*a*, 14*b* that provide structural support for the chassis 12. Wheels 16*a*-16*d* are rotatably coupled to the chassis 12 and permit the tower 10 to be moved as desired. As best seen in FIG. 1, a towing bar 18 is connected to the chassis 12, and permits the tower 10 to be towed by a vehicle.

In this embodiment, the tower 10 is manually positioned into the desired location. Other means for moving the tower 10 are envisioned within the scope of this invention. For example, the tower 10 could be self-propelled (e.g., by a hydrostatic drive system for the wheels 16*a*-16*d*) or the chassis 12 could be mounted to a trailer (not shown). In self-propelled embodiments, movement of the tower 10 could be automated via a remote control device (wired or wireless) and processing means (not shown) or other known vehicle-control methods. Such a remote control device could also be used to actuate the hydraulic cylinders, the operation of which are discussed in greater detail herein.

In this embodiment, a ground-engaging portion 20 is connected to the chassis 12. The ground-engaging portion 20 is comprised of ground supports or outriggers 22*a*-22*d*. The extension length of the outriggers 22*a*-22*d* is adjusted, respectively, by outrigger cranks 28*a*-28*d*, and the outriggers 22*a*-22*d* are held in position, respectively, by outrigger pins 24*a*-24*d* (24*c* and 24*d* not labeled). In this embodiment, the outriggers 22*a*-22*d* are each fitted with multiple outrigger pin holes, e.g. pin hole 26, which allow for the respective outrigger 22*a*-22*d* to be set to the desired length via the insertion of the respective outrigger pin 24*a*-24*d*.

Figure 2:
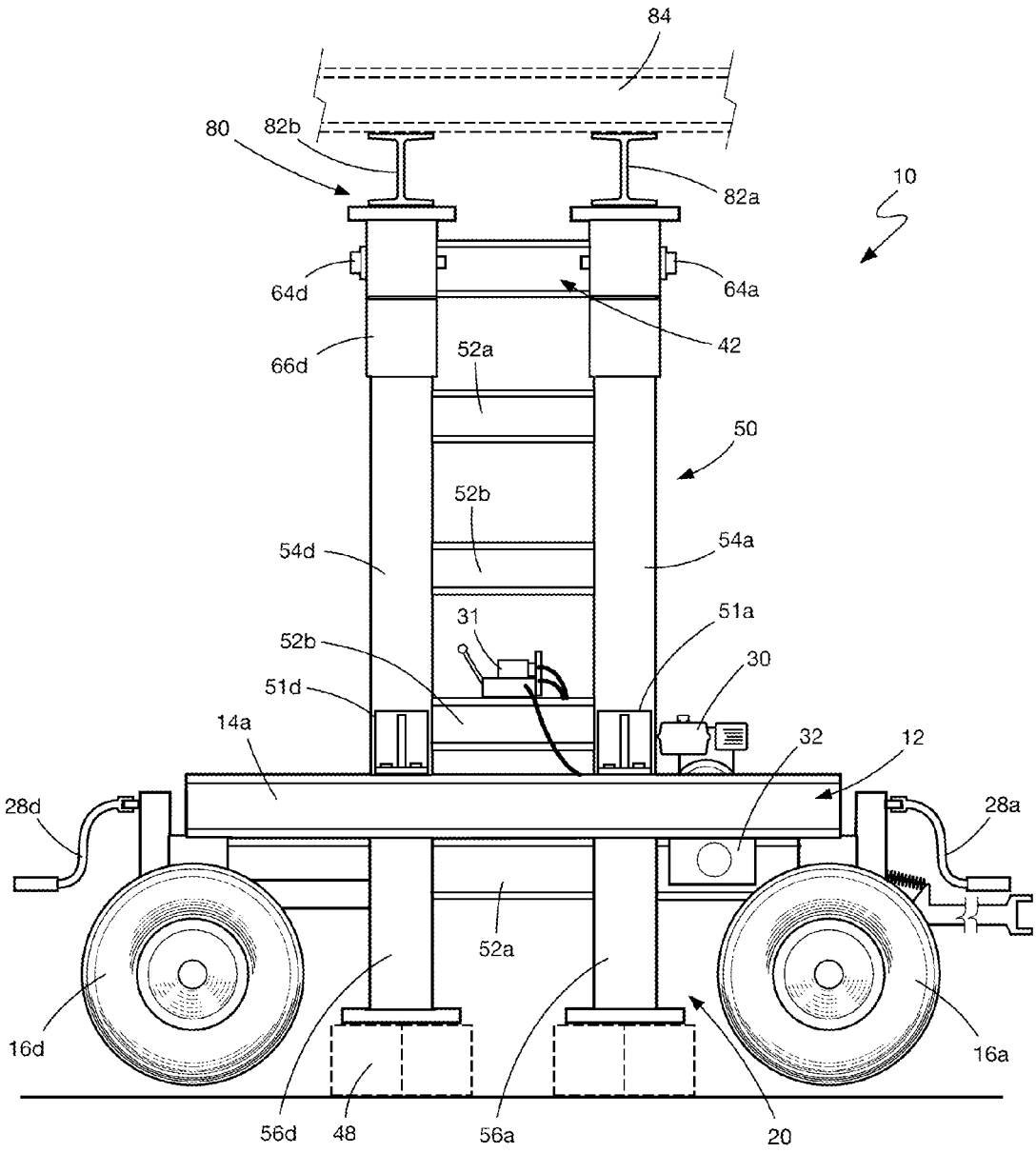
FIG. 2 is a right side view of the apparatus with the first support portion in engagement with the ground via dunnage.

While the tower 10 is being transported, the outriggers 22*a*-22*d* are refracted such that they do not make contact with the ground. After the tower 10 has been positioned in the desired location, the outriggers 22*a*-22*d* can then be extended. As best seen in FIG. 2, the outriggers 22*a*-22*d*, when extended, function to lift the wheels 16*a*-16*d* off of the ground. In addition, the outriggers 22*a*-22*d* are used to lift the ground-engaging portions 56*a*-56*d* of the respective vertical members 54*a*-54*d* above the ground to a height sufficient such that a ground-engaging apparatus, for example dunnage 48, can be placed between the ground and the ground-engaging portions 56*a*-56*d*. The outriggers 22*a*-22*d* are also used to provide overall stability to the apparatus by increasing the "footprint" area of the ground-engaging portion 20 of the tower 10.

In alternate embodiments (not shown), outriggers that are extendable outwardly from the chassis 12 (like those used to stabilize cranes, ladder trucks and aerial booms) may be included that provide increased stability to the tower 10 when it is positioned and operated. A secondary hydraulic unit, as described in greater detail below, may also be used to properly balance the tower 10 once it has been positioned in its desired location.

In the embodiment illustrated in the Figures, the dunnage 48 is wooden blocks with cross sections that are approximately 12 inches by 12 inches in size. It should be understood that many other types of dunnage could be used to stabilize the ground-engaging portions 56*a*-56*d* where the ground is unlevel or uneven, such as for example one or more sandbags, or blocks or shims made of wood, metal, rubber, or other suitable material. Regardless of what material is selected for the dunnage, it is desirable that the dunnage be arranged such that the tower 10 is as level as possible with the load to be engaged thereby, i.e. the top surface of the chassis beams 14*a*, 14*b* should be substantially parallel with the bottom surface of the load to be engaged by the tower 10. This parallel arrangement not only minimizes the risk that the tower 10 will become accidentally disengaged from the load, but also maximizes the lifting capacity of the tower 10, since the lifting force provided by the tower 10 is in a generally vertical direction. Preferably, the lifting force provided by the tower 10 is in a precise upward direction. The dunnage 48 also serves to distribute the weight of the tower 10 (and any load engaged thereby) over a larger surface area of the ground than would be engaged by the ground-engaging portions 56*a*-56*d* of the vertical members 54*a*-54*d* alone.

The tower 10 further comprises a power source 30, which in this embodiment is a gas-powered engine that drives a hydraulic pump 33. Other sources of power are envisioned within the scope of this invention, for example battery or plug-in electric power, or engines that consume other types of fossil fuels. A hydraulic fluid chamber 32 is operably connected to the hydraulic pump 33, and is further operably connected to a hydraulic cylinder control means 31 (see FIG. 2) via hydraulic fluid lines 34*a*, 34*b* (see FIG. 1). The control means 31 is further operably connected to a pair of extension and retraction devices. In this embodiment, the extension and retraction devices are hydraulic cylinders 36*a*, 36*b*.

In this embodiment, the tower 10 comprises a first support portion 50. The first support portion 50 is comprised of vertical beams 54*a*-54*d*, which terminate at their respective bottom ends at ground-engaging portions 56*a*-56*d*. In this embodiment, the vertical beams 54*a*-54*d* are arranged such that when viewed in cross-section from above they form the corners of a rectangle. It should be understood that other cross-sectional shapes for the first support portion are suitable, for example square or triangular. In this embodiment, adjacent vertical beams are joined by one or more horizontal supports, such as for example horizontal beams 52*a*-52*b*, which join together vertical beams 54*a* and 54*d* (see FIG. 2) and horizontal beams 52*c*-52*d*, which join together vertical beams 54*b* and 54*c* (see FIG. 4). A greater or lesser number of horizontal and vertical beams could be used to provide the requisite structural integrity to the first support portion 50, within the scope of this invention. At least three vertical beams are preferred.

Figure 3:
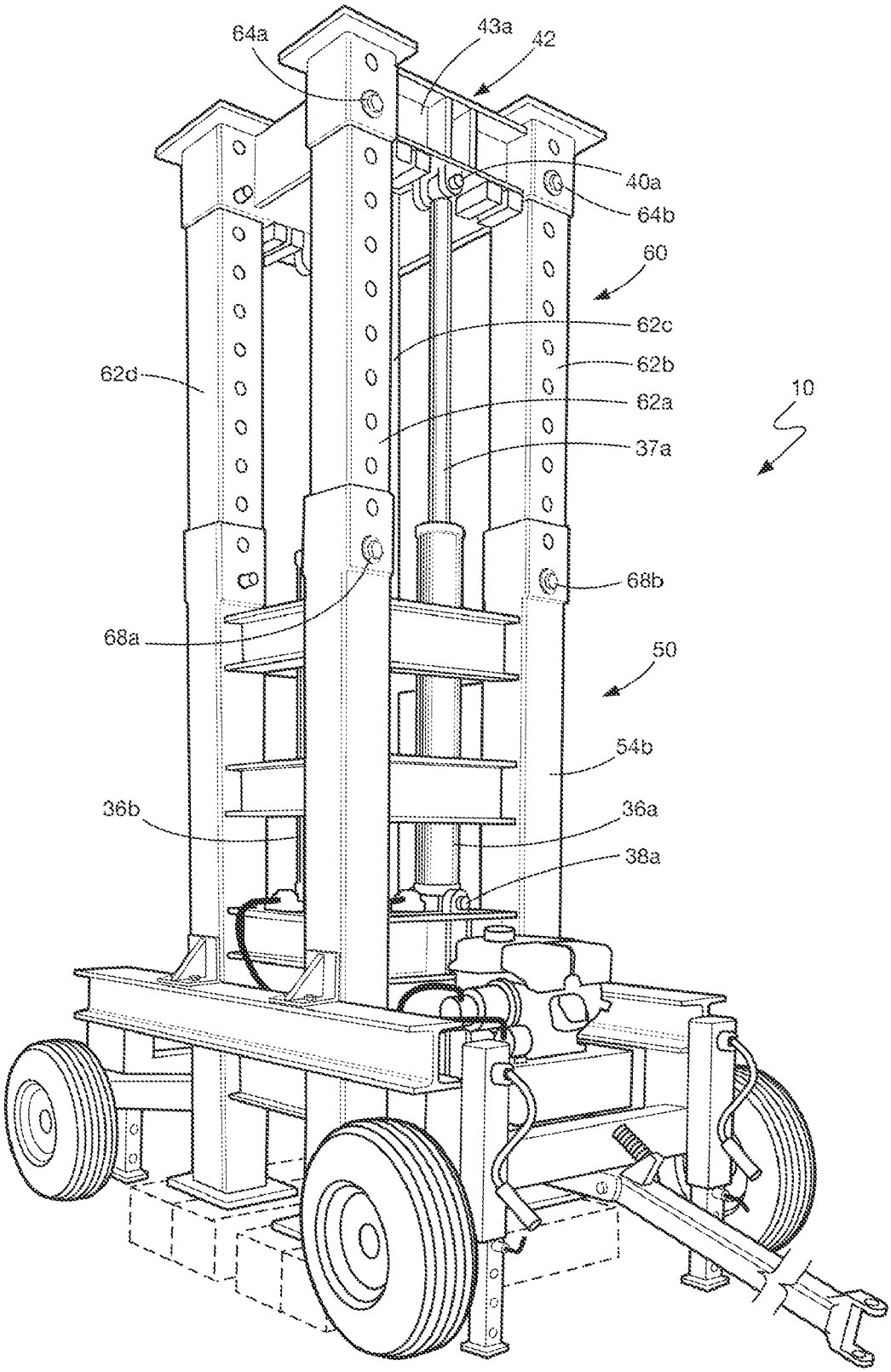
FIG. 3 is a front perspective view of the apparatus with the second support portion in a fully-extended position.
Figure 5:
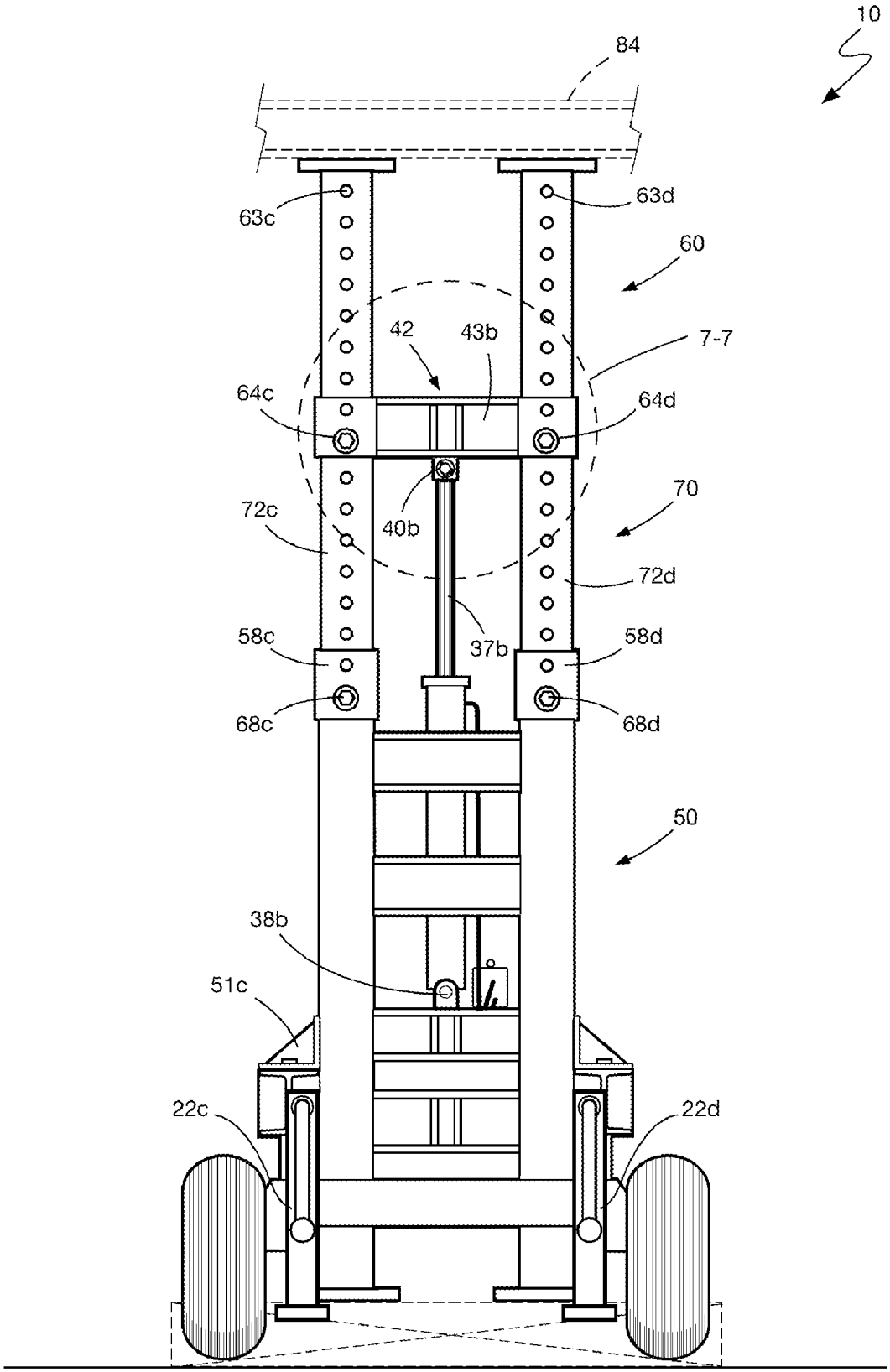
FIG. 5 is a rear view of the apparatus with the second and third support portions in fully-extended positions.

In this embodiment, the vertical beams 54*a*-54*d* are joined to the transport chassis 12 via brackets 51*a*-51*d* (bracket 51*c* is shown in FIG. 5). As can be seen in FIGS. 1 and 5, brackets 51*a* and 51*d* connect vertical beams 54*a* and 54*d*, respectively, to the transport chassis 12 via chassis beam 14*a*. Likewise, brackets 51*b* and 51*c* connect vertical beams 54*b* and 54*c*, respectively, to the chassis 12 via chassis beam 14*b*. In this embodiment, the brackets 51*a*-51*d* are welded to the respective vertical beam 54*a*-54*d*, and are affixed to the respective chassis beam 14*a*, 14*b* via bolts or rivets. It should be understood that the brackets 51*a*-51*d*, vertical beams 54*a*-54*d*, and chassis beams 14*a*, 14*b* could be connected via known welding techniques or via nuts and bolts, rivets, or other suitable fasteners, within the scope of this invention.

Where reference is made in this application to the connectivity and functionality of hydraulic cylinder 36*a*, it should be understood that hydraulic cylinder 36*b* functions identically thereto. Referring now to FIGS. 1 and 3, hydraulic cylinder 36*a* is connected at one end to a vertical beam 51 of the first support portion 50 at a first connection point 38*a*, and at a second end (i.e. the end containing the piston rod 37*a*) to a beam 43*a* of a support portion-engaging unit 42 at a second connection point 40*a*. In this embodiment, the first connection point 38*a* remains stationary at all times during the operation of the tower 10.

In an alternate embodiment (not shown), the first connection point 38*a* of the hydraulic cylinder 36*a* could be free to shift upwards after an initial extension motion, thereby retracting the piston rod 37*a* while bringing the bottom of the hydraulic cylinder 36*a* to a raised position approximately level to the top of the first support portion 50. The first connection point 38*a* could then be supported at this level, via a support pin or other suitable means, and the piston rod 37*a* could again be extended such that the third support portion 70 is raised out of its nested position within the first support portion 50. In this embodiment, the support portion-engaging unit 42 could be eliminated, and the second connection point 40*a* could be located directly on the bottom surface of a load-engaging portion 80.

Returning to the embodiment shown in the attached Figures, support portion-engaging unit 42 is comprised of two beams 43*a*, 43*b* (see FIGS. 3 and 5) that respectively include the second connection points 40*a*, 40*b*, and two beams 44*a*, 44*b* (see FIG. 4) that connect the beams 43*a*, 43*b* together such that the support portion-engaging unit 42 is a rigid, level structure of approximately rectangular shape when viewed in cross-section from above. The support portion-engaging unit 42 further comprises sleeves 74*a*-74*d* (see FIGS. 4 and 6) located at its respective corners. The sleeves 74*a*-74*d* are fitted around vertical beams 62*a*-62*d*, respectively, and have pin-receiving holes (not labeled) formed therein. The sleeves 74*a*-74*d* may be releasably connected to and are slidable along the respective vertical beams 54*a*-54*d*.

Figure 7:
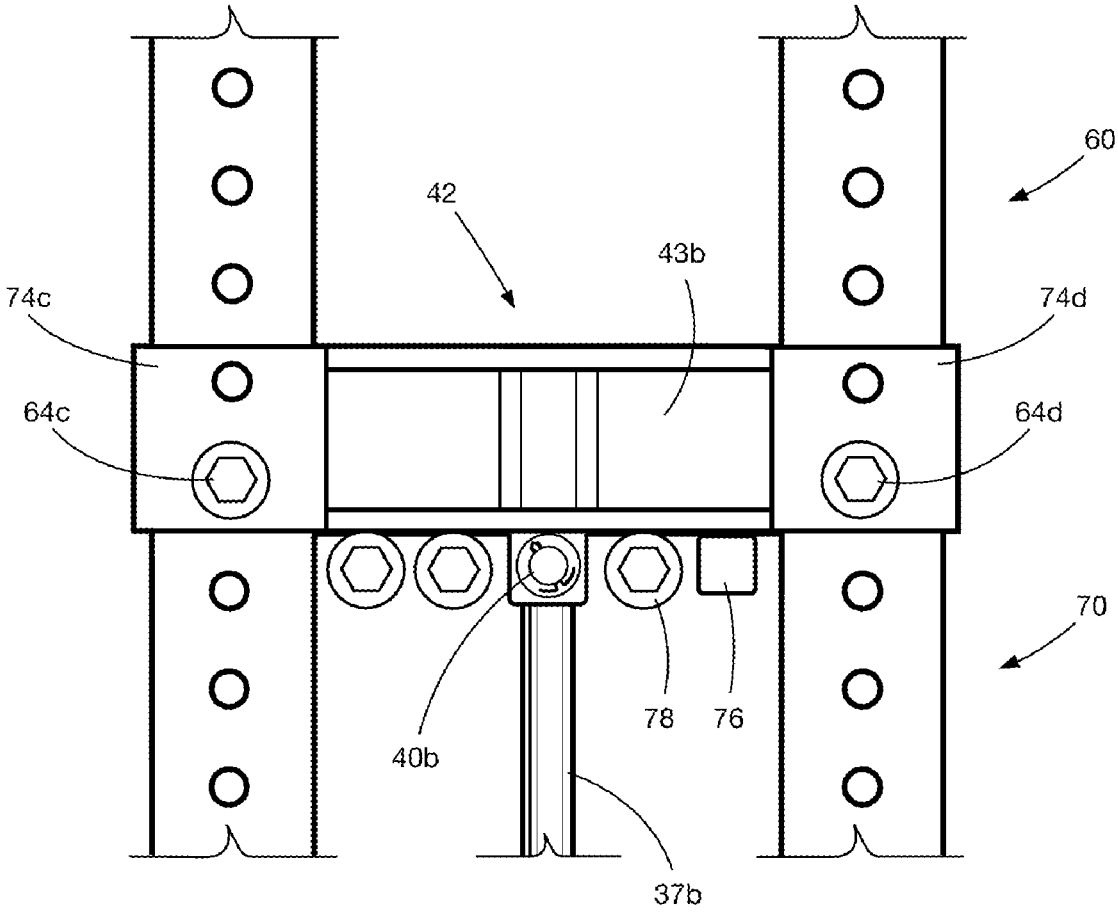
FIG. 7 is a view of the area contained approximately within line 7-7 of FIG. 5.

FIG. 7 is a view of the area contained approximately within line 7-7 of FIG. 5, showing the support portion-engaging unit 42 in greater detail. In this embodiment, the support portion-engaging unit 42 has multiple pin-storage slots, e.g. slot 76, which are sized to hold stored pins, such as pin 78, when not in use. It should be understood that the support portion-engaging unit could be of any suitable structure and design within the scope of this invention. The support portion-engaging unit need only be designed such that it has means for engaging the one or more extension and retraction devices, and means for engaging the one or more support portions of the apparatus. In an alternate embodiment, as discussed above, the support portion-engaging unit may be eliminated completely.

In FIGS. 1 and 2, the tower 10 is shown in its fully retracted position. As best seen in FIG. 1, when the tower 10 is in the retracted position, no pins need be inserted into the pin-receiving holes, e.g. pin-receiving holes 66*a*-66*d*, that are located, respectively, in plates 58*a*-58*d* (plates 58*c*, 58*d* are shown in FIG. 5) at the top of the respective vertical beams 54*a*-54*d*. In the retracted position, the tower 10 requires no bracing via support pins because the vertical beams 62*a*-62*d* that comprise the second 60 and third 70 support portions (see FIGS. 5 and 6) are fully nested within the vertical beams 54*a*-54*d* that comprise the first support portion 50, and the vertical beams 62*a*-62*d* rest at the bottom of the respective ground-engaging portions 56*a*-56*d*. The second support portion 60 and the third support portion 70 are telescopically movable with respect to the first support portion 50.

Figure 4:
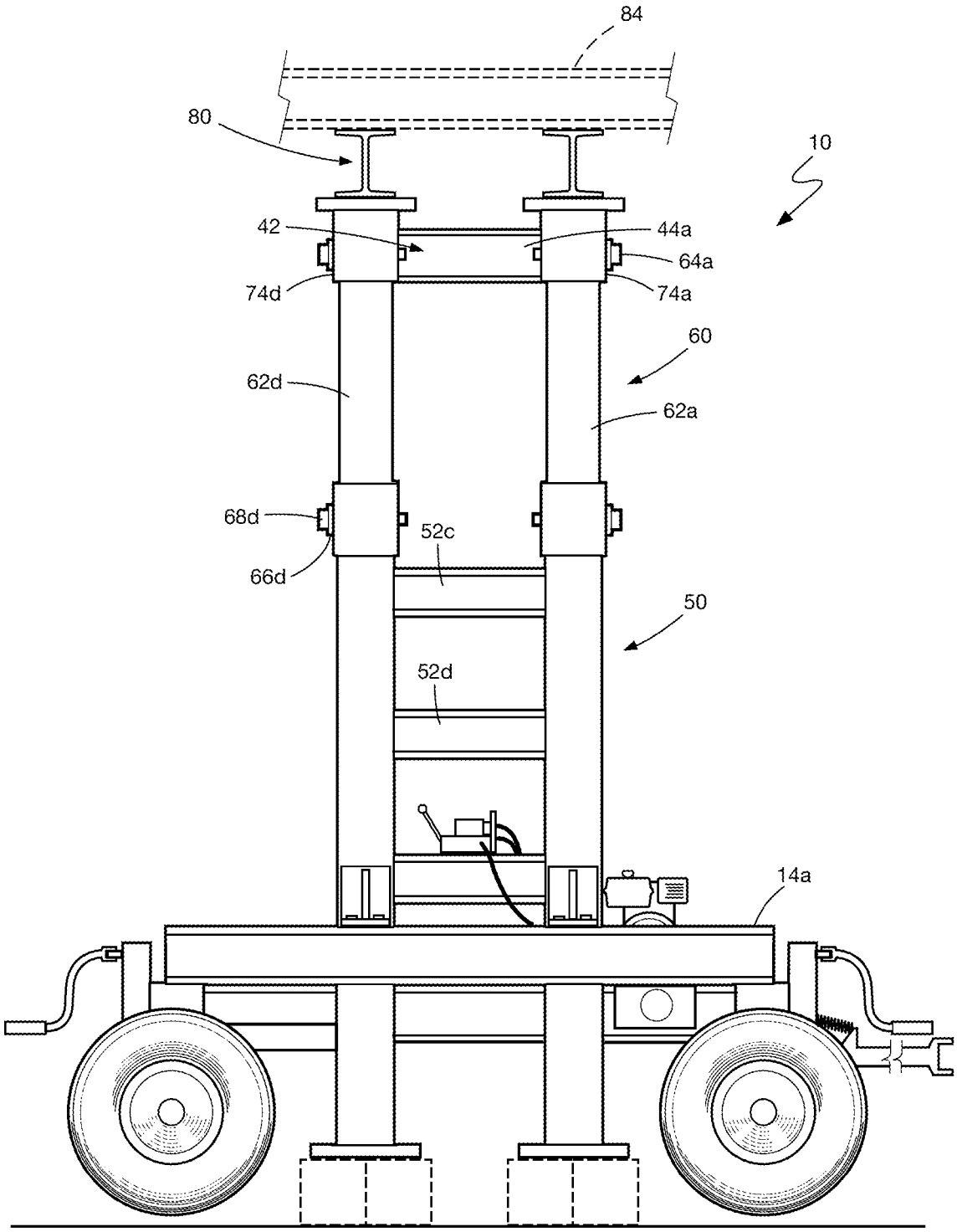
FIG. 4 is a right side view of the apparatus as shown in FIG. 3.

Referring now to FIGS. 3 and 4, the tower 10 is shown in a partially extended configuration, wherein second support portion 60 has been fully extended from out of its nested position within the first support portion 50. In this embodiment, in order for the second support portion 60 to be moved into an extended position, the support portion-engaging unit 42 is first coupled via one or more support pins 64*a*-64*d* (see FIG. 5) to pin-receiving holes, e.g. pin-receiving holes 63*c*, 63*d* (see FIG. 5), which are located in the vertical beams 62*a*-62*d*. The piston rod 37*a* of the hydraulic cylinder 36*a* is then extended the desired distance, such that the support portion-engaging unit 42 draws the attached vertical beams 62*a*-*d* upward an equivalent distance.

When the maximum, or desired, height of the second support portion 60 has been reached, the user inserts support pins 68*a*-68*d* into pin-receiving holes 66*a*-66*d* (see FIGS. 1, 4, and 6), respectively. In this embodiment, the support pins 68*a*-68*d* extend entirely through the respective vertical beam 62*a*-62*d*, such that the weight of the second support portion 60, the load-engaging portion 80 (discussed in greater detail below), and any load engaged thereby is supported by the support pins 68*a*-68*d*. Once the support pins 68*a*-68*d* have been placed within the respective pin-receiving holes 66*a*-66*d*, the support portion-engaging unit 42 may be disengaged from the vertical beams 62*a*-62*d* via removal of support pins 64*a*-64*d*, respectively. If, at this stage, the desired height of the tower 10 has been reached, it is most preferable to maintain the hydraulic cylinder 36*a* in the extended position and the support portion-engaging unit 42 in engagement with the vertical beams 62*a*-62*d*, respectively, for maximum structural rigidity of the tower 10. In the alternative, if the desired height of the tower 10 has not been reached, the sleeves 74*a*-74*d* of the support portion-engaging unit 42 may be disengaged from the vertical beams 62*a*-62*d*, the piston rod 37*a* of the hydraulic cylinder 36*a* retracted, and the support portion-engaging unit 42 lowered to its rest position. In this embodiment, where the desired height of the tower 10 has not yet been reached, these steps must be taken in order to put the support portion-engaging unit 42 and the hydraulic cylinder 36*a* in a position to further extend the height of the tower 10.

Figure 6:
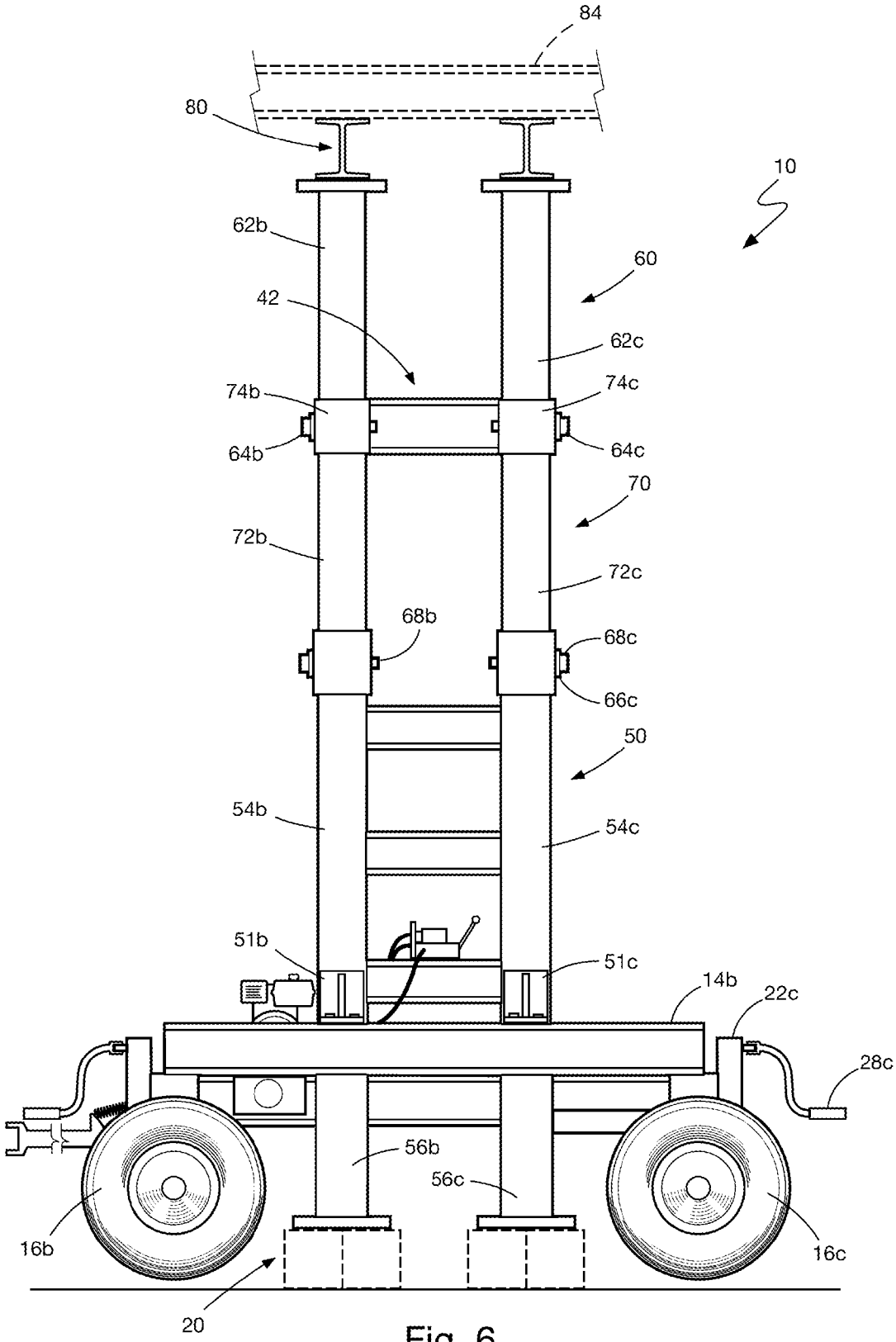
FIG. 6 is a left side view of the apparatus as shown in FIG. 5.

Referring now to FIGS. 5 and 6, the tower 10 is shown in a fully extended configuration, wherein third support portion 70 has been extended from out of its nested position within the first support portion 50. In order to extend the third support portion 70 from out of its nested position with the first support portion 50, the support portion-engaging unit 42 must first be fully lowered into the position shown in FIGS. 1 and 2 and as described above. The support portion-engaging unit 42 is then coupled via support pins 64*a*-64*d* to additional pin-receiving holes (not labeled), which are located in the lower portions 72*a*-72*d* of the respective vertical beams 62*a*-62*d*. Once the support pins 64*a*-64*d* have been positioned within respective pin-receiving holes, they will provide the structural support necessary such that support pins 68*a*-68*d* may be removed from pin-receiving holes 66*a*-*d*, respectively, without the second 60 and third 70 support portions falling back into a nested position within the first support portion 50 via the force of gravity. Removal of the support pins 68*a*-68*d* thus permits the piston rod 37*a* of the hydraulic cylinder 36*a* to then be extended the desired distance, such that the support portion-engaging unit 42 draws the lower portions 72*a*-72*d* (lower portion 72*a* not shown in the figures) of the respective vertical beams 62*a*-*d* upward an equivalent distance.

Because the vertical beams 62*a*-62*d* rest at the bottom of the respective ground-engaging portions 56*a*-56*d*, the vertical beams 62*a*-62*d* are approximately the same length as the respective ground-engaging portions 56*a*-56*d*, and full extension of the vertical beams 62*a*-62*d* almost doubles the height of the tower 10, thereby allowing the tower 10 to support a load that is located significantly higher than the height of the tower 10 when the vertical beams 62*a*-62*d* are at the bottom of the respective ground-engaging portions 56*a*-56*d*. Conversely, because the height of the tower 10, when the vertical beams 62*a*-62*d* are at the bottom of the respective ground-engaging portions 56*a*-56*d*, is only about half the height of the tower 10 when the vertical beams 62*a*-62*d* are fully extended from the respective ground-engaging portions 56*a*-56*d*, the tower 10 can be transported under most road overpasses without difficulty.

When the maximum, or desired, height of the third support portion 70 has been reached, the user reinserts support pins 68*a*-68*d* into pin-receiving holes 66*a*-66*d*, respectively. Support pins 68*a*-68*d* are again inserted entirely through the respective vertical beam 62*a*-62*d*, such that the weight of the second support portion 60, third support portion 70, the load-engaging portion 80, and any load engaged thereby can be supported by the support pins 68*a*-68*d*. The support pins 64*a*-64*d* may then be removed such that the support portion-engaging unit 42 is disengaged from the vertical beams 62*a*-62*d*, allowing the piston rod 37*a* of the hydraulic cylinder 36*a* to be fully retracted. More preferably, for added structural rigidity, the hydraulic cylinder 36*a* is maintained in a fully extended position and the support portion-engaging unit 42 is maintained in engagement with the vertical beams 62*a*-62*d* via support pins 68*a*-68*d*, respectively.

As can be seen in FIG. 6, the load-engaging portion 80 is vertically aligned with the ground-engaging portion 56 of the first support portion 50. This enables the load being supported by the tower 10 to be transmitted directly to the ground through the vertical beams 62*a*-62*d*, the ground-engaging portion 56*a*-*d*, and the dunnage 48 placed between the ground-engaging portion 56*a*-*d* and the ground.

It should be noted that when the tower 10 is in a fully-extended position, the box-like structure of the support portion-engaging unit 42 adds a significant amount of lateral stability to the beams 62*a*-62*d*. This enables the tower 10 to support much larger loads than would be possible without the support portion-engaging unit 42.

When the user desires to remove the tower 10 from the extended height, the second 60 and/or third 70 support portions may be lowered back into a nested position within the first support portion 50 by substantially reversing the lifting process as described above. The tower 10 can then be quickly moved to another location and re-extended for continued use.

Referring again to FIG. 2, located at the top of the tower 10 is the load-engaging portion 80. In this embodiment, the load-engaging portion 80 is comprised of a pair of beams 82*a*, 82*b*, which are mounted to the top of the vertical beams 62*a*-62*d*. Beam 82*a* is mounted to the top of vertical beams 62*a* and 62*b*, and beam 82*b* is mounted to the top of vertical beams 62*c* and 62*d*. In this embodiment, beams 82*a*, 82*b* are mounted to the vertical beams 62*a*-62*d* via a plurality of rivets. Other affixation techniques, such as the use of nuts and bolts or known welding techniques, should be understood as being within the scope of this invention. The load 84 located on top of the beams 82*a*, 82*b* are representative of a load that would be engaged by the load-engaging portion 80 when the beams 82*a*, 82*b* are placed in a position adjacent thereto. Most preferably, as shown in FIGS. 1-6, the load-engaging portion 80 engages the load 84 such that the load 84 is perpendicular to and substantially centered on the beams 82*a*, 82*b*. This ensures the most stable connection between the beams 82*a*, 82*b* and the load 84. It should be understood that other engagement angles and alignments between the beams 82*a*, 82*b* and the load 84 are envisioned within the scope of this invention.

It should also be understood that the load-engaging portion may comprise any number of alternate structures, such as for example where the load-engaging portion comprises a structure with a wider load-contacting area or a structure that is specifically shaped, sized, or configured in order to more effectively engage the load. The load-engaging portion could also be changeable, such that a user could quickly replace the load-engaging portion with a structure having a desired shape, size, or configuration. Storage areas for alternate load-engaging portions could be provided on or in engagement with the body of the apparatus.

In the embodiment as substantially shown in FIGS. 1-7, the weight-bearing components of the tower 10 are constructed of construction-grade steel. In field tests, Applicant has determined that this embodiment of the tower 10 has a lifting capacity of at least 300 tons (about 272,000 kg). In an exemplary use, the tower 10 may be used to support bridge beams during construction and/or repair work on a bridge.

In the alternative, other suitable materials, for example metals or plastics, may be used to construct some or all of the weight-bearing components of the apparatus.

In an alternative embodiment (not shown), the tower 10 could include a secondary extension and retraction means, which may be a secondary hydraulic unit. The secondary hydraulic unit may, in one embodiment, be located between the load-engaging portion 80 and the top of the vertical beams 62*a*-62*d*. In the alternative, the secondary hydraulic unit could be located below the first support portion 50. Other locations for the secondary hydraulic unit are also envisioned within the scope of this invention.

Preferably, the secondary hydraulic unit is comprised of one or more hydraulic cylinders that are shorter in length and/or greater in diameter—and have a greater lifting capacity—than the hydraulic cylinders 36*a*, 36*b*. In one embodiment, the hydraulic cylinders 36*a*, 36*b* would provide the means for adjusting the tower 10 to the proper height, i.e. would be used to move the load-engaging portion 80 into contact with the load 84. Once the load 84 has been placed adjacent to the load-engaging portion 80, the tower 10 would be secured by support pins 64*a*-64*d* and 68*a*-68*d* as substantially described above. The secondary hydraulic unit could then be used to perform the function of displacing the load 84.

In addition, the secondary hydraulic unit could be used in addition to, or instead of, the outriggers 22*a*-22*d* to raise the wheels 16*a*-16*d* off of the ground so that the ground-engaging portion 20 is placed in contact with the ground and/or dunnage 48. Where the secondary hydraulic unit is comprised of more than one hydraulic cylinder, the separate cylinders could be operated independently to assist in leveling the tower 10.

In an alternate embodiment, the tower 10 could be operated entirely via hydraulic means. The wheels 16*a*-16*d*, outriggers 22*a*-22*d*, outrigger pins 24*a*-24*d*, and support pins 64*a*-64*d*, and 68*a*-68*d*, for example, could be adjusted, positioned, engaged, and/or disengaged via hydraulic control means.

Figure 8:
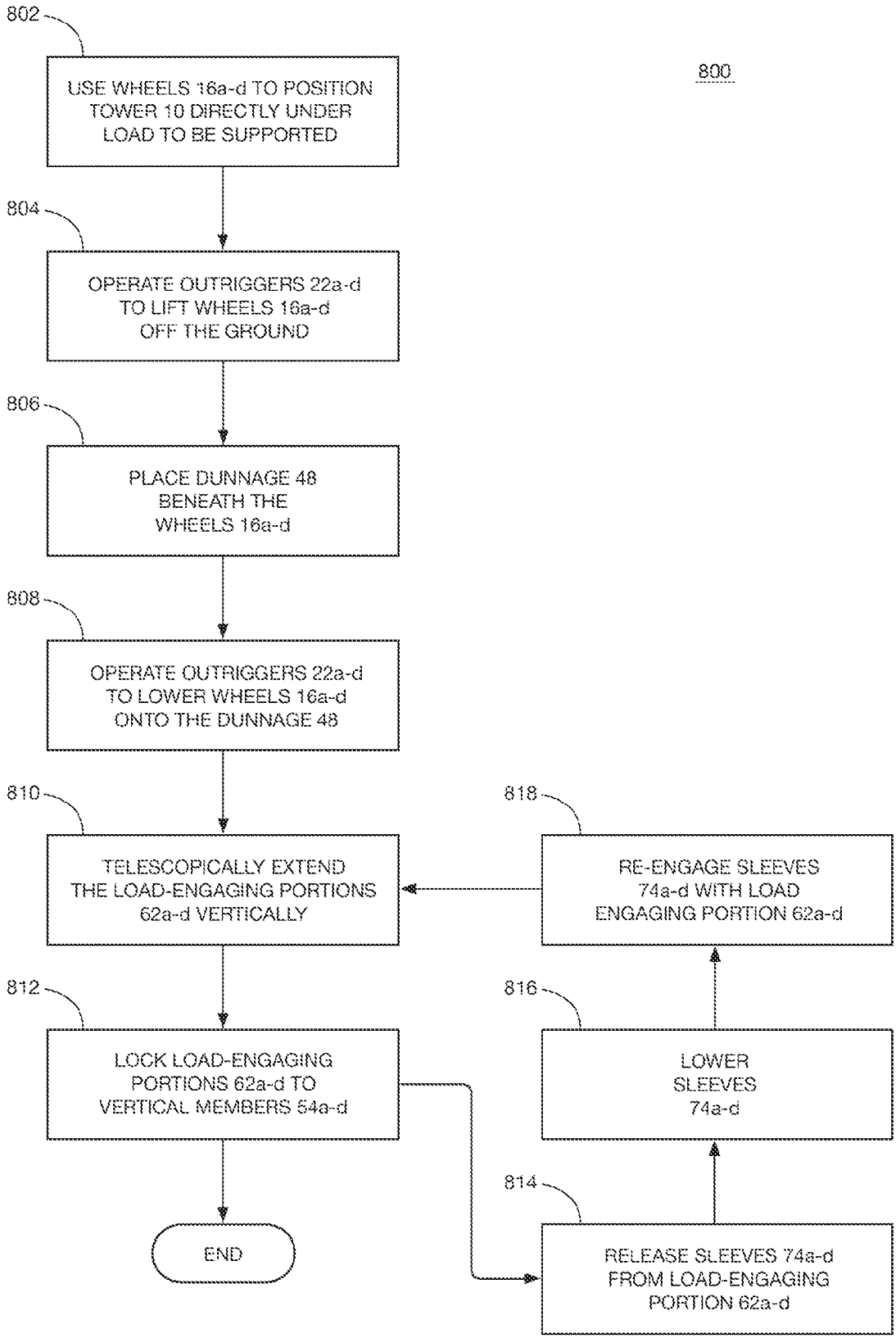
FIG. 8 is a flowchart illustrating an exemplary method of operating the apparatus of FIGS. 1-7.

Referring to the flowchart 800 of FIG. 8, an exemplary method of operating tower 10 is described. In step 802, wheels 16*a-d* are used to position tower 10 directly beneath a load to be supported, such as, for example, load 84 shown in FIG. 5. The tower 10 may be towed into the desired position. In step 804, outriggers 22*a-d* are operated to lift wheels 16*a-d* off the ground. In step 806, after the wheels 16*a-d* are lifted sufficiently from the ground, dunnage 48 is placed below the wheels 16*a-d* and, in step 808, the outriggers 22*a-d* are operated to lower the ground-engaging portions 56*a-d* onto the dunnage 48.

In step 810, the vertical beams 62*a-d* are telescopically extended vertically to engage the load. In step 812, the vertical beams 62*a-d* are securely locked into the vertical members 54*a-d*, respectively. Optionally, in step 814, if the load is too high, the sleeves 74*a-d* are released from the vertical beams 62*a-d* and in step 816, the sleeves 74*a-d* are lowered. In step 818, the sleeves are re-engaged with the vertical beams 62*a-d* and, repeating step 810, the sleeves 74*a-d* are extended until they engage and support the load-engaging portion 80.

Figure 9:
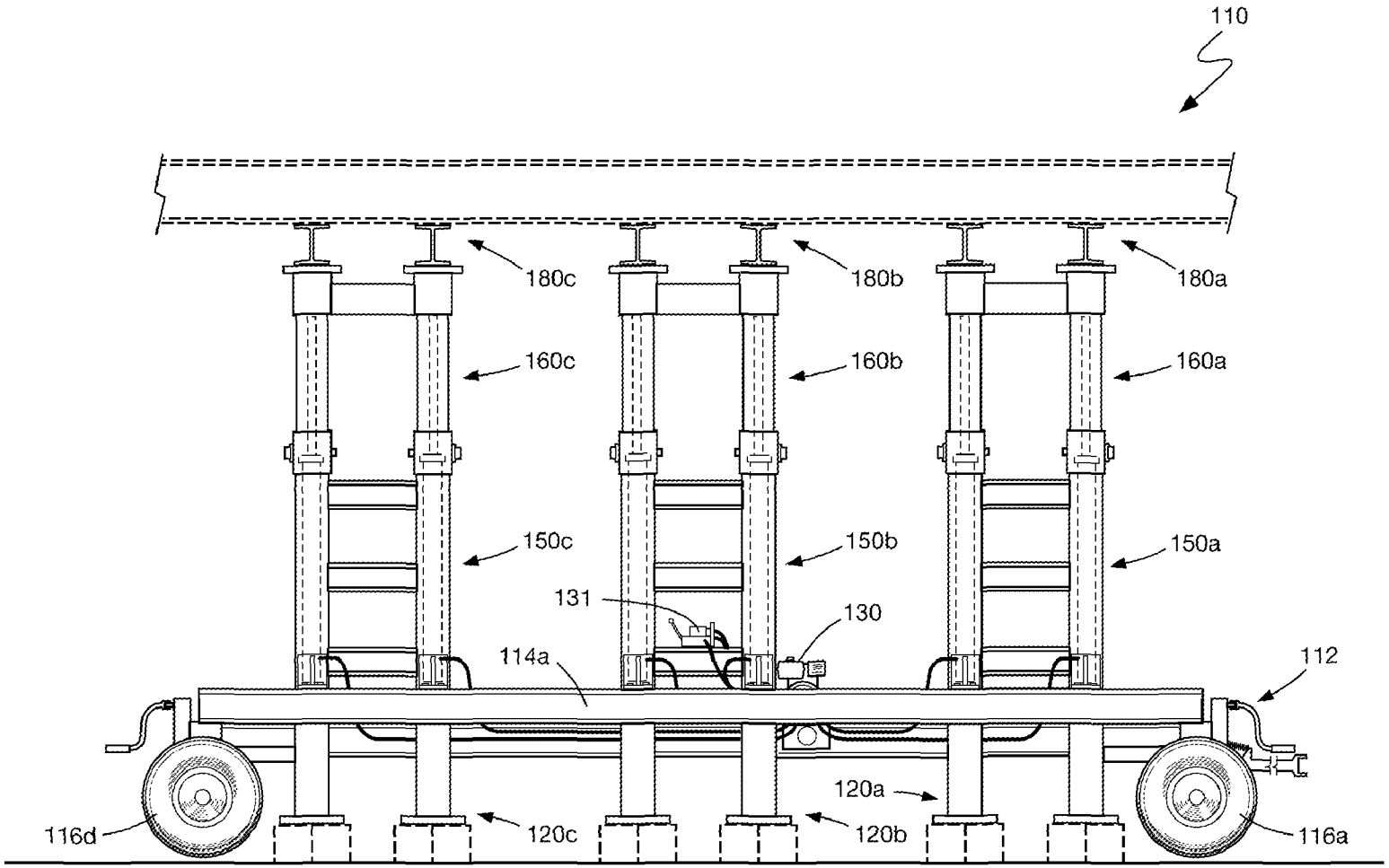
FIG. 9 is a right side view of an alternative embodiment of an apparatus according to the present invention.

An embodiment of a tower 110 according to an alternative exemplary embodiment of the present invention is illustrated in FIG. 9. In this example, elements shared with the first example are represented by reference numerals increased by factors of 100. For example, the chassis 14 of the first example corresponds to the chassis 114 of the second example. In the interest of clarity, some features of this embodiment that are shared with the first embodiment are numbered in FIG. 8, but are not repeated in the specification.

Tower 110 includes an elongated chassis 112 comprised of a pair of horizontal chassis beams (only one chassis beam 114*a* shown in FIG. 9) that support a plurality of first support portions 150*a*, 150*b*, 150*c*. While three of the first support portions 150*a*, 150*b*, 150*c* are shown, those skilled in the art will recognize that more or less than three of the first support portions 150*a*, 150*b*, 150*c* may be incorporated onto chassis 112.

Each of the first support portions 150*a*, 150*b*, 150*c* supports a respective second support portion 160*a*, 160*b*, 160*c* in the same manner that second support portion 60 is supported by first support portion 50 as described above. A load-engaging portion 180*a*, 180*b*, 180*c*, respectively, is supported by a respective second support portion 160*a*, 160*b*, 160*c* in the same manner that load-engaging portion 80 is supported by second support portion 60 as described above.

A power source 130 is operably connected to a hydraulic cylinder control means 131. Hydraulic cylinder control means 131 is used to independently operate each of the second support portions 160*a*, 160*b*, 160*c* to raise and lower the second support portions 160*a*, 160*b*, 160*c* from within the first support portions 150*a*, 150*b*, 150*c*, respectively, in a manner similar to operation of the tower 10 described above.

While the principles of the invention have been described above in connection with preferred embodiments, it is to be clearly understood that this description is made only by way of example and not as a limitation of the scope of the invention.

The invention claimed is:

1. An apparatus comprising:

a chassis;

a first support structure attached to the chassis and comprising a plurality of vertical support members, each of the plurality of vertical support members having a load-engaging portion located at an upper end, a ground-engaging portion located at a lower end, and a telescoping portion that enables the load-engaging portion to be raised and lowered relative to the ground-engaging portion, the ground-engaging portion extending below the chassis, wherein the load-engaging portion, ground-engaging portion, and telescoping portion are vertically aligned and the telescoping portion is releasably connectable to the ground-engaging portion and moveable with respect to the ground-engaging portion; and at least one extension and retraction device that is adapted to engage the telescoping portion and to cause the telescoping portion to extend and retract.

2. The apparatus of claim 1, wherein the first support structure further comprises a first locking structure having a locked position in which the position of the telescoping portion is fixed relative to the ground-engaging portion and an unlocked position in which the telescoping portion is vertically movable relative to the ground-engaging portion.

3. The apparatus of claim 1, wherein the first locking structure comprises a first hole located on the ground-engaging portion a second hole located on the telescoping portion and a plurality of pins.

4. The apparatus of claim 1, further comprising a support portion-engaging unit having a first position in which the position of the support portion-engaging unit is fixed relative to the telescoping portion of each of the plurality of vertical support members and a second position in which the support portion-engaging unit is vertically movable relative to the telescoping portion of each of the plurality of vertical support members, the support portion-engaging unit being secured to the at least one extension and retraction device.

5. The apparatus of claim 4, wherein the support portion-engaging unit comprises a plurality of sleeves and a plurality of beams, each of the plurality of sleeves encircling one of the telescoping portions and each of the plurality of beams rigidly connecting one of the plurality of sleeves to another one of the plurality of sleeves.

6. The apparatus of claim 4, further comprising a second locking structure having a locked position in which the position of the support portion-engaging unit is fixed relative to the telescoping portion and an unlocked position in which the support portion-engaging unit is vertically movable relative to the telescoping portion.

7. The apparatus of claim 1, wherein the chassis further comprises a plurality of wheels rotatably attached thereto.

8. The apparatus of claim 7, further comprising a plurality of outriggers, each of the outriggers having an extended position in which the outrigger extends below the plurality of wheels and a retracted position in which no portion of the outrigger extends below the plurality of wheels.

9. The apparatus of claim 1, wherein the first support structure further comprises a plurality of cross-members, each of the cross-members being attached to at least two of the plurality of vertical support members.

10. The apparatus of claim 1, wherein the at least one extension and retraction device comprises a plurality of hydraulic cylinders.

11. The apparatus of claim 1, further comprising a second support structure that is substantially identical to the first support structure.

12. The apparatus of claim 1, wherein the chassis is mobile and self-propelled or towable.

13. A method comprising:

(a) positioning a support apparatus on a support surface and beneath a load that is located above the support surface, the support apparatus comprising a chassis and a support structure having a plurality of support members, each of the support members having a telescoping portion, a load-engaging portion, and a ground-engaging portion, wherein the telescoping portion is releasably connectable to and vertically aligned with the ground-engaging portion of said support member and vertically aligned with the load-engaging portion of said support member;

(b) engaging the support surface with the ground-engaging portion of each of the plurality of support members in a manner that results in the chassis being suspended above the support surface;

(c) extending each of the telescoping portions of each of the plurality of support members of the support apparatus until the load-engaging portion of each of the telescoping portions has engaged the load; and (d) locking the position of each of the telescoping portions relative to the ground-engaging portion of a respective one of the plurality of support members.

14. The method of claim 13, wherein step (b) comprises lifting the chassis above the support surface, placing dunnage between the support surface and the ground-engaging portion of each of the plurality of support members, and lowering the chassis until each of the ground-engaging portions is resting atop the dunnage and the chassis remains suspended above the support surface.

15. The method of claim 13, wherein step (c) further comprises extending each of the telescoping portions using a plurality of hydraulic cylinders that are connected to each of the telescoping portions via a support portion-engaging unit.

16. The method of claim 13, wherein step (c) comprises the follow sub-steps:

(i) locking a support portion-engaging unit to each of the telescoping members;

(ii) moving the support portion-engaging unit;

(iii) unlocking the support portion-engaging unit from each of the telescoping members; and (iv) lowering the support portion-engaging unit relative to each of the telescoping members.

17. An apparatus comprising:

a chassis;

a first support structure attached to the chassis and comprising a plurality of vertical support members, each of the plurality of vertical support members having a load-engaging portion located at a top end of a telescoping portion and a ground-engaging portion located at a bottom end of said vertical support member, the ground-engaging portion extending below the chassis, the telescoping portion being releasably connectable to the ground-engaging portion to enable the load-engaging portion to be raised and lowered relative to the ground-engaging portion; and at least one extension and retraction device that is adapted to engage the telescoping portion to enable the telescoping portion to be raised and lowered.

18. The apparatus of claim 17, wherein the load-engaging portion of each of the plurality of vertical support members is vertically aligned with the ground-engaging portion thereof.

19. The apparatus of claim 17, further comprising:

a support portion-engaging unit secured to the at least one extension and retraction device, the support portion-engaging unit having a first position in which the position of the support portion-engaging unit is fixed relative to the telescoping portion of each of the plurality of support members and a second position in which the support portion-engaging unit is vertically movable relative to the telescoping portion of each of the plurality of support members; and a locking structure having a locked position in which the position of the support portion-engaging unit is fixed relative to the telescoping portion and an unlocked position in which the support portion-engaging unit is vertically movable relative to the telescoping portion.

20. The apparatus of claim 17, wherein the chassis is mobile.

* * * * *